US008177017B2

(12) United States Patent
Asam et al.

(10) Patent No.: US 8,177,017 B2
(45) Date of Patent: May 15, 2012

(54) TRAVELING WORKING MACHINE

(75) Inventors: Dirk Asam, Ulm (DE); Robert Foehr, Bad Waldsee (DE); Roland Wachter, Oberroth (DE); Bernd Wager, Kirchdorf/Iller (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 214 days.

(21) Appl. No.: 12/580,168

(22) Filed: Oct. 15, 2009

(65) Prior Publication Data

US 2010/0096211 A1 Apr. 22, 2010

(30) Foreign Application Priority Data

Oct. 17, 2008 (DE) ..... 20 2008 013 896 U

(51) Int. Cl.
*B62D 21/00* (2006.01)
*E02F 3/00* (2006.01)
*E02F 9/08* (2006.01)

(52) U.S. Cl. ..... 180/311; 37/347; 37/466; 280/781; 403/150

(58) Field of Classification Search ..... 37/231, 37/347, 466, 468; 172/272; 180/311, 781, 180/785; 296/190.04, 190.05; 403/288, 403/150, 151, 157, 158
See application file for complete search history.

(56) References Cited

U.S. PATENT DOCUMENTS 3,271,058 A * 9/1966 Anderson ..... 403/408.1
3,963,132 A * 6/1976 Dufour ..... 414/719
4,055,262 A * 10/1977 Bauer et al. ..... 414/697
4,096,957 A * 6/1978 Iverson et al. ..... 414/715
4,151,920 A * 5/1979 Shoup ..... 414/697
4,640,641 A * 2/1987 Edelmayer ..... 403/150
5,320,443 A * 6/1994 Lien et al. ..... 403/154
5,984,036 A * 11/1999 Higuchi et al. ..... 180/89.12
6,039,497 A * 3/2000 Gullberg ..... 403/16
6,098,739 A * 8/2000 Anderson et al. ..... 180/312
6,170,588 B1 * 1/2001 Irino et al. ..... 180/89.1
6,322,104 B1 * 11/2001 Duppong et al. ..... 280/781
6,502,896 B1 * 1/2003 Nakata et al. ..... 296/190.05
6,575,659 B1 6/2003 Valtwies et al.
6,719,075 B2 * 4/2004 Kamikawa ..... 180/9.1
6,772,544 B2 * 8/2004 Takemura et al. ..... 37/347
6,886,277 B2 * 5/2005 Yukawa et al. ..... 37/347
6,922,925 B2 * 8/2005 Watanabe et al. ..... 37/466
(Continued)

FOREIGN PATENT DOCUMENTS

DE 3432194 3/1986
(Continued)

OTHER PUBLICATIONS

ISA European Patent Office, Search Report of EP 09 01 2099, Feb. 22, 2010, 6 pages.
(Continued)

*Primary Examiner* — Paul N Dickson
*Assistant Examiner* — Laura Freedman
(74) *Attorney, Agent, or Firm* — Alleman Hall McCoy Russell & Tuttle LLP

(57) ABSTRACT

The present invention relates to a traveling working machine, in particular an excavator, with an undercarriage on which the traveling gear is arranged, and an uppercarriage rotatably arranged on the undercarriage about a vertical axis of rotation. In accordance with the invention, the load-bearing steel construction of the uppercarriage is composed of at least one first and one second element, which are connected with each other via bolts and/or screws.

12 Claims, 9 Drawing Sheets

U.S. PATENT DOCUMENTS

| | | | | |
|---|---|---|---|---|
| 7,156,200 | B2 * | 1/2007 | Dershem et al. | 180/311 |
| 7,204,546 | B2 * | 4/2007 | Antonetti | 296/190.04 |
| 7,287,810 | B2 * | 10/2007 | Ishii et al. | 296/190.05 |
| 7,374,208 | B2 * | 5/2008 | Yamamoto et al. | 280/834 |
| 7,404,595 | B2 * | 7/2008 | Mori | 296/190.03 |
| 7,500,532 | B2 * | 3/2009 | Koga et al. | 180/89.13 |
| 7,775,556 | B2 * | 8/2010 | Sakamoto et al. | 280/781 |
| 7,854,284 | B2 * | 12/2010 | Wada et al. | 180/89.13 |
| 7,886,633 | B2 * | 2/2011 | Tanaka | 74/560 |
| 7,900,730 | B2 * | 3/2011 | Hokimoto | 180/89.1 |
| 7,942,222 | B2 * | 5/2011 | Yonetake et al. | 180/68.4 |
| 2005/0166429 | A1 * | 8/2005 | Tanaka et al. | 37/466 |
| 2006/0080930 | A1 * | 4/2006 | Brindle | 52/655.1 |
| 2007/0175849 | A1 * | 8/2007 | Yokoyama et al. | 212/180 |
| 2008/0273938 | A1 * | 11/2008 | Rowe et al. | 411/102 |
| 2009/0202316 | A1 * | 8/2009 | Petri Larrea | 411/49 |
| 2009/0285654 | A1 * | 11/2009 | Stecher et al. | 411/426 |

FOREIGN PATENT DOCUMENTS

| | | | | |
|---|---|---|---|---|
| DE | 29718592 | | | 2/1998 |
| DE | 11 2005 000 728 | | | 3/2007 |
| DE | 102005052014 | | | 5/2007 |
| EP | 1329414 | | | 7/2003 |
| EP | 1647635 | | | 4/2006 |
| EP | 1647635 | A2 | | 4/2006 |
| EP | 1903153 | | | 3/2008 |
| EP | 2000678 | | | 12/2008 |
| GB | 482315 | | | 3/1938 |
| GB | 2427666 | | | 3/2007 |
| JP | 59085037 | | | 5/1984 |
| JP | 62001939 | A | * | 1/1987 |
| JP | 05005319 | A | * | 1/1993 |
| JP | 06212665 | A | * | 8/1994 |
| JP | 06294146 | A | * | 10/1994 |
| JP | 20000038742 | A | | 2/2000 |
| JP | 2002/097667 | | | 4/2002 |
| JP | 2006200313 | | | 8/2006 |
| JP | 2006298355 | | | 11/2006 |
| JP | 2008007966 | | | 1/2008 |
| WO | 2007068937 | | | 6/2007 |

OTHER PUBLICATIONS

German Patent and Trademark Office, Search Report of German Application No. 20 2008 013 896.5, May 4, 2009, Germany.

* cited by examiner

TRAVELING WORKING MACHINE

CROSS REFERENCE TO RELATED APPLICATION

This application claims priority to German Patent Application No. 20 2008 013 896.5, filed Oct. 17, 2008, which is hereby incorporated by reference in its entirety for all purposes.

TECHNICAL FIELD

The present invention relates to a traveling working machine, in particular an excavator, with an undercarriage on which the traveling gear is arranged, and an uppercarriage rotatably arranged on the undercarriage about a vertical axis of rotation.

The uppercarriage of such traveling working machines usually carries the drive unit, e.g. a powerpack of engine and hydraulic pumps, and a dipper arm or boom which is pivotally attached to the uppercarriage about a horizontal swivel axis. To absorb the forces to be transmitted, the uppercarriage usually includes a welded construction which is rotatably arranged on the undercarriage via a slewing ring and which carries the dipper arm or boom, the drive unit and the ballast. Due to the large dimensions of the uppercarriages used e.g. in large hydraulic excavators, problems increasingly arise as regards the handling of the load-bearing welded construction of the uppercarriage during manufacture and transport.

Therefore, it is the object of the present invention to provide a traveling working machine which is easier to handle in terms of manufacture and transport.

This object is solved, in one example, by a traveling working machine in particular an excavator. The travelling working machine may include an undercarriage on which the traveling gear is arranged and an uppercarriage rotatably arranged on the undercarriage about a vertical axis of rotation. In accordance with the invention, it now is provided that the load-bearing steel construction of the uppercarriage is composed of at least one first and one second element, which are connected with each other via bolts and/or screws. As a result, the load-bearing steel construction of the uppercarriage can be fabricated in two parts, which each can be handled much more easily than the entire construction. These two parts, which each are configured as welded construction, then are connected with each other via bolts and/or screws. As a result, the dimensions of the welded constructions necessary for fabricating the load-bearing steel construction of the uppercarriage can be maintained within a range which still can be handled easily.

Due to the at least two-part construction of the inventive load-bearing steel construction of the uppercarriage, advantages are obtained both in terms of the manufacture and in terms of the transport of the traveling working machine, since the connection of the two elements by bolts and/or screws also can be released again for disassembly of the working machine.

Advantageously, the first element includes a slewing ring for the rotatable attachment of the uppercarriage to the undercarriage and/or connecting regions for connection with a dipper arm, boom or working tool. Accordingly, the first element of the load-bearing steel construction of the uppercarriage serves the rotatable connection of the uppercarriage with the undercarriage and/or the pivotal attachment of a dipper arm, boom or working tool. Usually, the first element of the load-bearing steel construction therefore carries a base plate, on which the slewing ring is arranged, and side panels for pivotal attachment of the dipper arm, boom or working tool. The side panels usually are disposed vertically on the base plate and extend parallel to each other along the longitudinal direction of the uppercarriage.

On the other hand, the second element advantageously carries the ballast and/or the drive unit, in particular the powerpack of the working machine. Accordingly, the second element of the load-bearing steel construction usually is arranged on the rear side of the uppercarriage and carries the elements of the traveling working machine arranged there. The second element likewise advantageously comprises a base construction and two side panels, which extend in longitudinal direction of the uppercarriage.

Advantageously, connecting regions for connecting the first and second elements are arranged on the side panels of the first and/or the second element. In particular, bolt receptacles for bolting the first and second elements are arranged on the side panels of the first and/or the second element. Furthermore advantageously, screw connections for screwing the first and second elements are arranged on the side panels of the first and/or the second element.

Advantageously, the connection of the first and second elements comprises at least one, advantageously two bolt connections whose bolting axis extends horizontally. Advantageously, the two bolt connections include a common bolting axis. Via the horizontally extending bolt connections, great forces, in particular great tensile forces, can be transmitted between the two elements. Advantageously, the bolt connections are arranged on the side panels of the first and/or the second element.

Advantageously, the second element furthermore supports the first element in at least one stop region. In this stop region, compressive forces easily can be transmitted from one steel construction to the other. In particular, the compressive forces occurring as a result of the ballast arranged on the second element can be forwarded to the first element in the stop region. Advantageously, the stop region is arranged below the bolting axis and absorbs forces acting in a plane vertical to the bolting axis.

Advantageously, the connection of the first and second elements furthermore comprises at least one, advantageously two screw connections which advantageously are arranged in the stop region. The screw connections thus lock the connection of the first element with the second element against a movement of the second element about the bolting axis.

Advantageously, the screwing axes are orthogonal to the bolting axis, wherein the screwing axes advantageously extend horizontally. This provides an optimum effect of locking by the screws, which therefore only are subjected to a tensile or shear stress. Advantageously, the screw connections are arranged in the base region of the first and second elements.

Advantageously, the connection of the first with the second element comprises at least one, advantageously two bolt connections, which as bolt include a split bushing with conical inside diameter and a pressing piston with conical outside diameter. This ensures a backlash-free bolt connection, so that possibly used screw connections only are loaded along the screwing axis. The pressing piston is pressed into the split bushing, so that the outside diameter of the split bushing is increased and the same is braced against the bolt receptacles on the first and second elements. The split bushing has a cylindrical outside diameter and advantageously is slotted in longitudinal direction.

Advantageously, the pressing piston is pressed into the split bushing via a clinch screw. This provides for safe compression of the pressing piston, for which purpose e.g. a hydraulic drive can be used.

Advantageously, the clinch screw is screwed into a holder which is screwed to a welded construction carrying the bolt receptacle. The bolt receptacle advantageously is arranged on a side panel of the first or the second element. To this side panel a holder then is screwed, which carries the thread for screwing in the clinch screw.

Advantageously, the clinch screw has a diameter which is more than half, advantageously more than three quarters of the diameter of the bolt. On the one hand, this ensures a large-surface compression between the clinch screw and the pressing piston. In addition, the lever arm between the thread for the clinch screw and the attachment of the holder to the welded construction is kept short, so that the bending moments in the holder stay low. Advantageously, the diameter of the clinch screw approximately is at least as large as the outside diameter of the bolt.

Furthermore advantageously, the end face of the pressing piston includes a connecting element for connection with a tension element, in particular a thread for screwing in a pull-off screw. As a result, the pressing piston can be withdrawn from the split bushing for releasing the connection between the first and second elements, in order to thus release the bracing of the bolt connection.

For this purpose, a washer advantageously is provided, on which the pull-off screw is supported, wherein the washer advantageously is supported on the holder into which the clinch screw can be screwed. If the pull-off screw accordingly is screwed into the thread on the end face of the pressing piston, its head is supported on the washer, so that the pressing piston can be withdrawn from the split bushing.

The present invention also comprises corresponding methods for mounting or demounting the first element on the second element or for making or releasing the corresponding bolt connections.

The present invention furthermore comprises a set of a bolt, a clinch screw, a holder and advantageously a washer, as described above. The bolt includes a split bushing with conical inside diameter and a pressing piston with conical outside diameter, wherein the pressing piston can be pressed into the split bushing via the clinch screw. Furthermore advantageously, the set comprises a corresponding pull-off screw for withdrawing the piston.

The present invention furthermore comprises a steel construction of an uppercarriage of a traveling working machine as described above. In accordance with the invention, the load-bearing steel construction of the uppercarriage includes at least one first element and at least one second element, which are connected with each other via bolts and/or screws. The two elements each are configured as welded construction. Further properties of the load-bearing steel construction are described above with respect to the traveling working machine.

Due to the inventive two-part steel construction of the uppercarriage, handling is simplified considerably both during construction and transport, since the two elements can be manufactured separately as a welded construction and only then are connected with each other as finished parts via bolts and/or screws.

BRIEF DESCRIPTION OF FIGURES

The present invention will now be illustrated in detail with reference to an embodiment and drawings.

DETAILED DESCRIPTION

Figure 1:
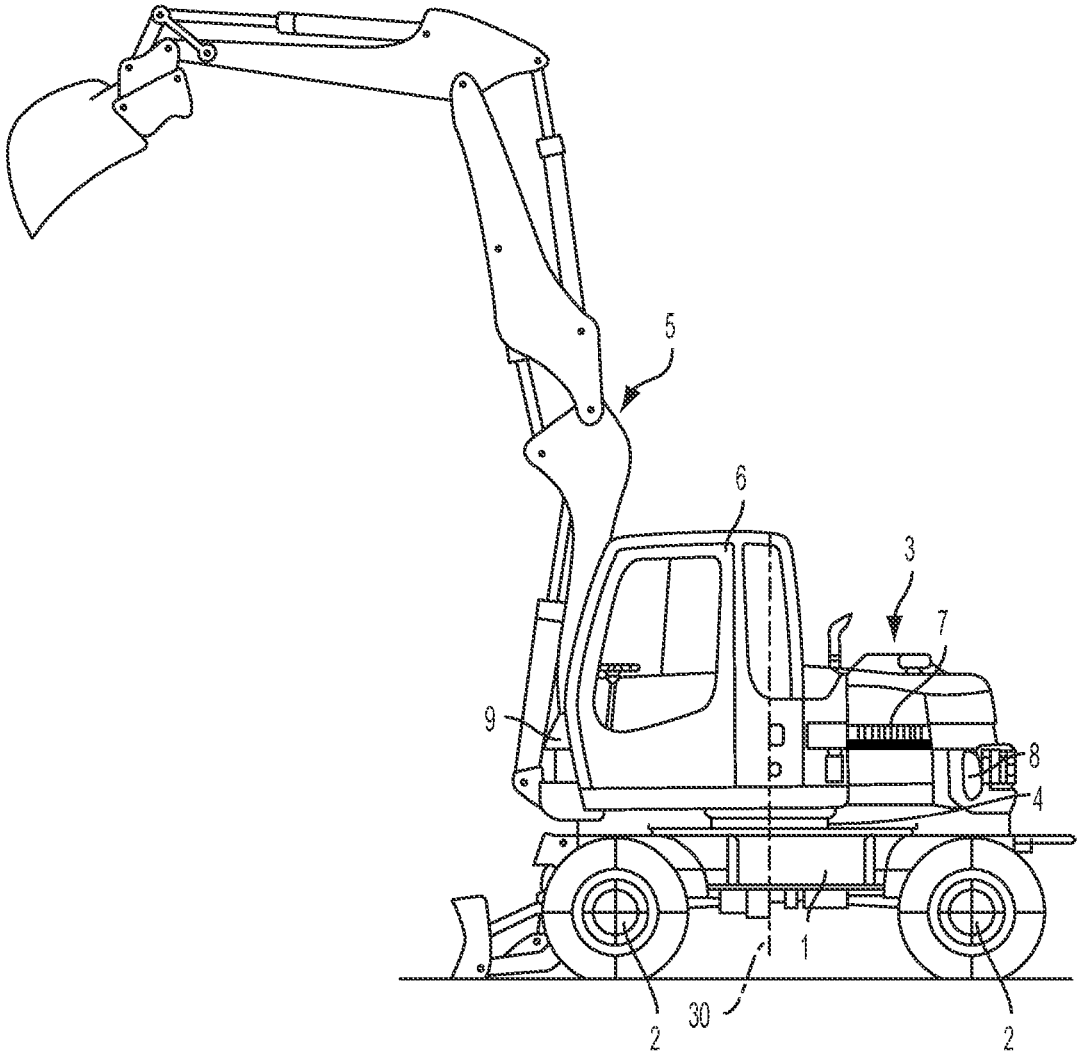
FIG. 1 shows an embodiment of a traveling working machine of the invention, in which the inventive two-part load-bearing steel construction of the uppercarriage is employed.
Figure 2:
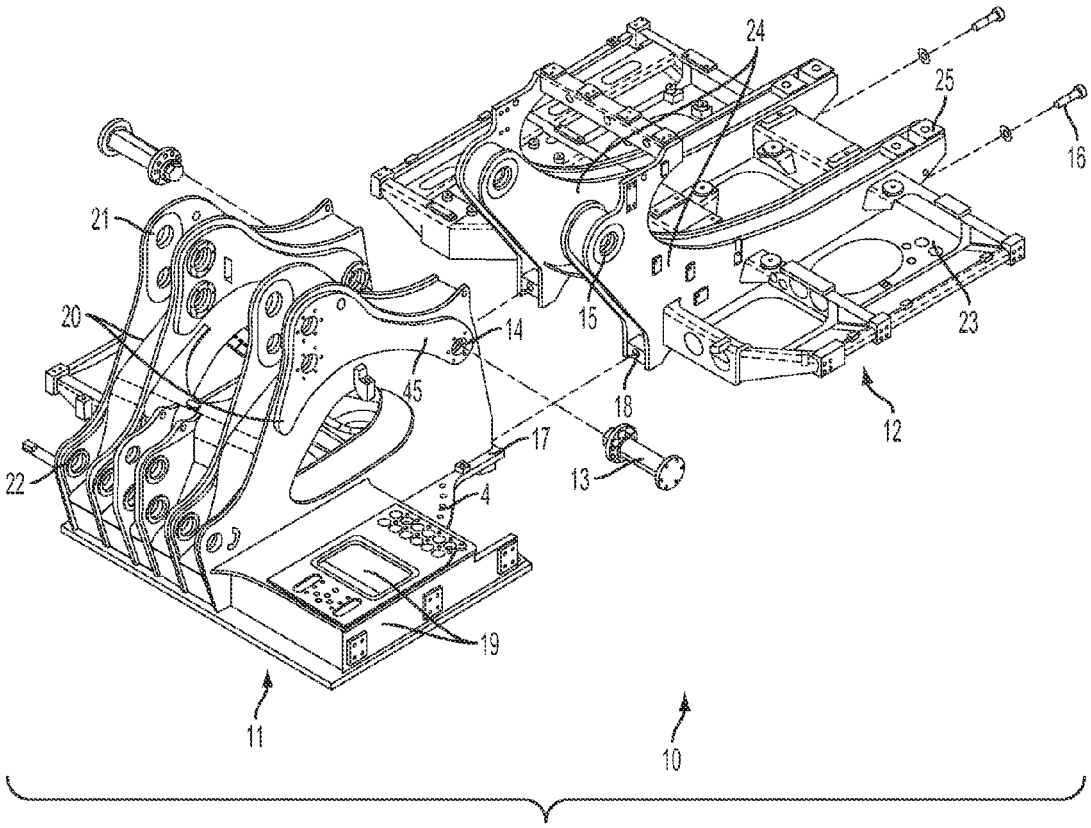
FIG. 2 shows an embodiment of the inventive load-bearing steel construction of the uppercarriage in a perspective view.

FIG. 1 shows an embodiment of a traveling working machine, in which the inventive two-part steel construction of the uppercarriage is employed. The traveling working machine is a hydraulic excavator with an undercarriage 1 on which a traveling gear 2 is arranged, which comprises two tired axles. On the undercarriage 1, an uppercarriage 3 is arranged, which is rotatable about a vertical axis of rotation 30, for which purpose a slewing ring 4 is provided between undercarriage and uppercarriage. The uppercarriage 3 comprises a drive unit 7, in this case a powerpack of engine and hydraulic pumps for driving the hydraulic loads, in particular the hydraulic cylinders of the excavator arm (e.g., dipper arm) 5 and the traveling gear drives. Furthermore, a ballast 8 is provided on the uppercarriage. Furthermore, an excavator arm 5 is pivotally attached to the uppercarriage 3 in a front attachment region 9. The dipper arm 5 is pivotally attached to the uppercarriage about a horizontal swivel axis and carries the working tool, in this case an excavator shovel. Hydraulic cylinders are provided for moving the dipper arm 5 with respect to the uppercarriage. The uppercarriage 3 furthermore carries the driver cabin 6, which is arranged beside the attachment region 9 for the dipper arm 5.

An embodiment of the inventive two-part load-bearing steel construction 10 of the uppercarriage 3 now is shown in FIGS. 2 to 6. The load-bearing steel construction 10 comprises a first element 11 and a second element 12, which each are configured as welded construction and are connected with each other via bolts 13 and screws 16.

On the first element 11, the slewing ring 4 is arranged for rotatable attachment of the uppercarriage 3 on the undercarriage 1. Furthermore, the first element 11 includes the attachment regions 21 and 22 for connection with the dipper arm 5. The first element is composed of a base plate 19, on which the slewing ring 4 is arranged, and side panels 20. On the side panels 20, which are vertically arranged on the base plate 19 and extend along the longitudinal axis of the uppercarriage, there are provided the attachment regions 21 for pivotal attachment of an arm element and 22 for pivotal attachment of hydraulic cylinders for moving the arm. Furthermore, the first element 11 carries the driver cabin 6.

On the other hand, the second element 12 of the supporting steel construction, which is arranged on the rear, carries the ballast and the powerpack of the working machine. For this purpose, the second element 12 likewise includes a base construction 23 and two side panels 24. On the rear of the side panels 24 connecting regions 25 are provided, on which the ballast is mounted. The side panels 24 likewise extend in longitudinal direction of the uppercarriage, wherein they are flush with the side panels of the first element in the mounted position of the first and second elements.

For connecting the first and second elements, two bolt connections are provided, whose common bolting axis extends horizontally. For this purpose, bolt receptacles 14 are provided on the side panels 20 of the first element and bolt receptacles 15 on the side panels 24 of the second element 12, which are bolted together via bolts 13. The bolts thus fix the second element with respect to the first element along a common bolting axis. The bolt connections are releasably constructed. As a result, the first and second elements can be detached, e.g. for transport of the excavator. As can be taken in particular from FIG. 4, the bolts 13 are mounted from inside, since the oil tank is mounted to the left of the side panels and the fuel tank to the right of the side panels.

Furthermore, stop regions 17 and 18 are provided on the first and second elements, in which the second element supports the first element. In these stop regions, the static forces acting vertical to the bolting axis are absorbed. In particular, the static moments exerted by the own weight of the second element 12, the ballast and the powerpack are introduced into the first element 11 via the stop regions 17 and 18 vertical to the bolting axis acting as axis of rotation. The bolt connections substantially are subjected to a tensile stress, the stop regions substantially to a compressive stress. For this purpose, the stop regions are arranged below the bolting axis in the base region of the side panels.

Figure 3:
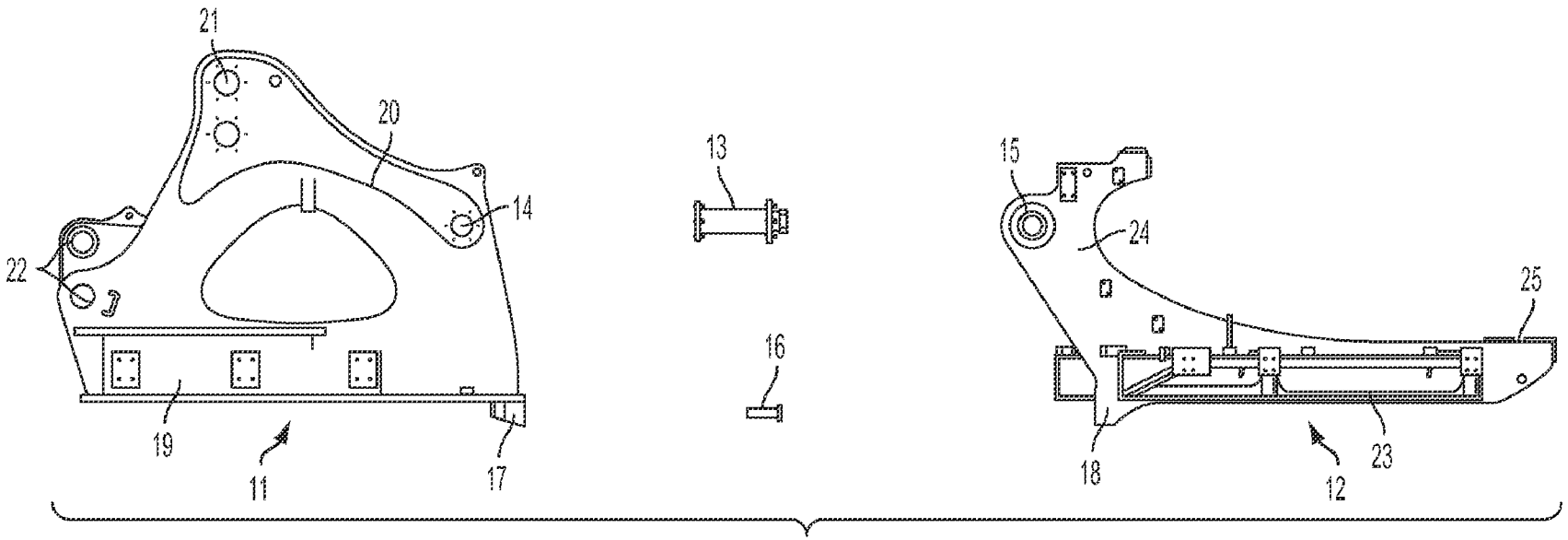
FIG. 3 shows the embodiment of the steel construction in a lateral exploded view.
Figure 4:
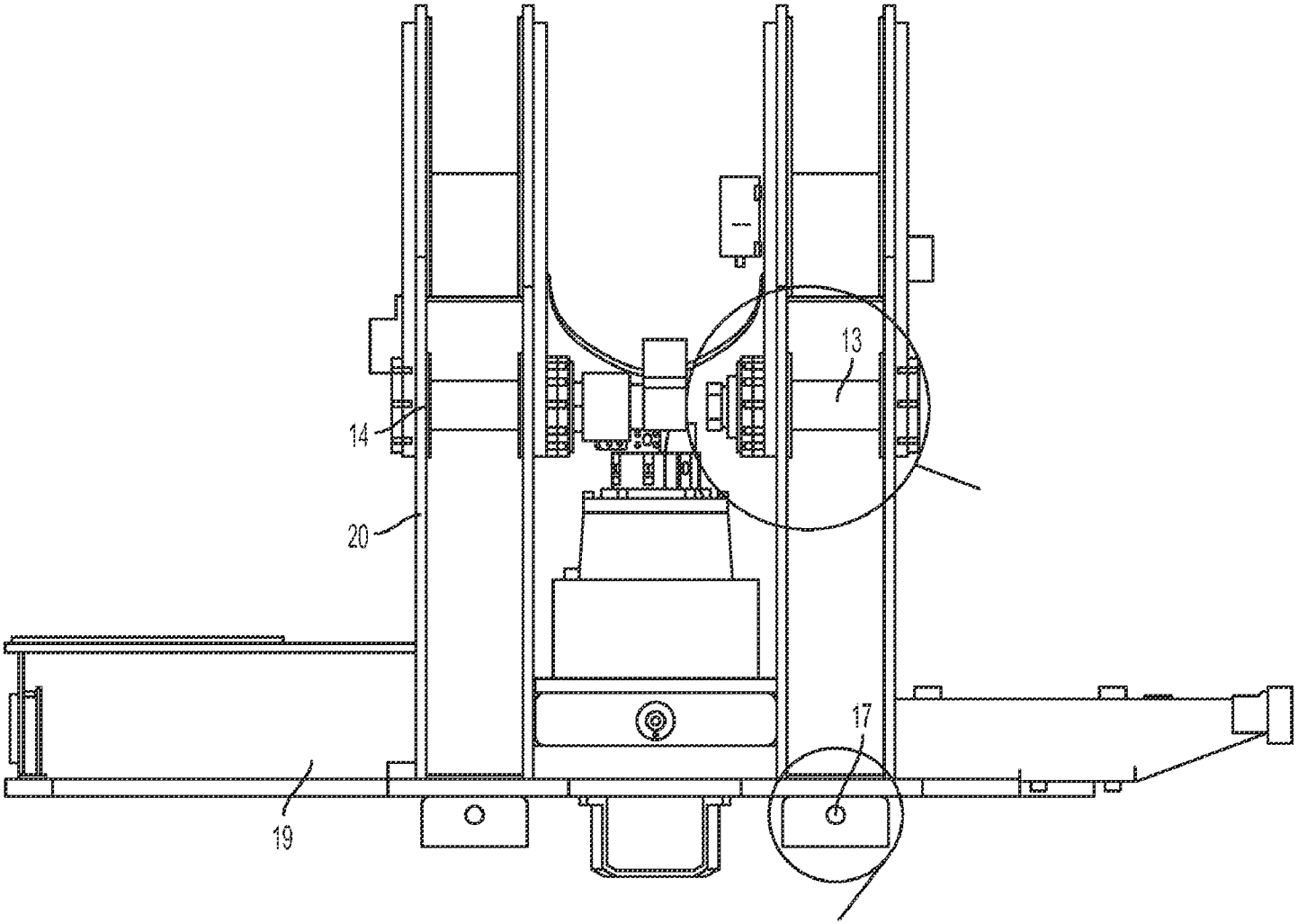
FIG. 4 shows the first element of the embodiment of the steel construction in a front view.
Figure 5:
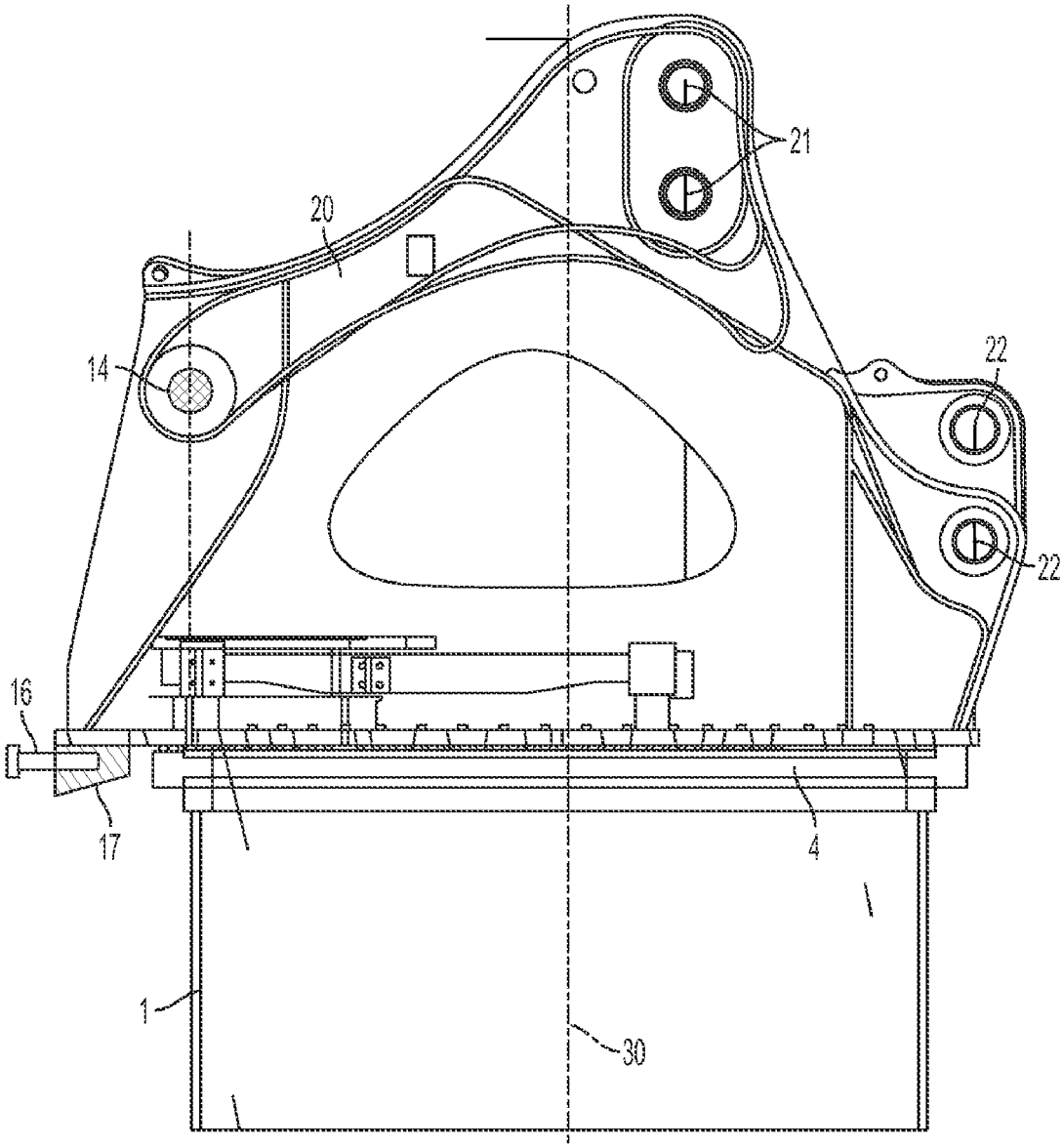
FIG. 5 shows the first element of the embodiment of the steel construction in a side view.

Furthermore, screws 16 are provided, which connect the first and second elements. The screw connections are arranged in the stop regions 17 and 18 on the first and second elements. The screwing axes are orthogonal to the bolting axis. As shown in FIG. 3, the screwing axes substantially extend horizontally in the base region of the first and second elements. In particular, the screw connections are arranged in the base region of the side panels 20 and 24 on the first and second elements. The screw connections serve to lock the first and second elements against a movement about the bolting axis.

Figure 6:
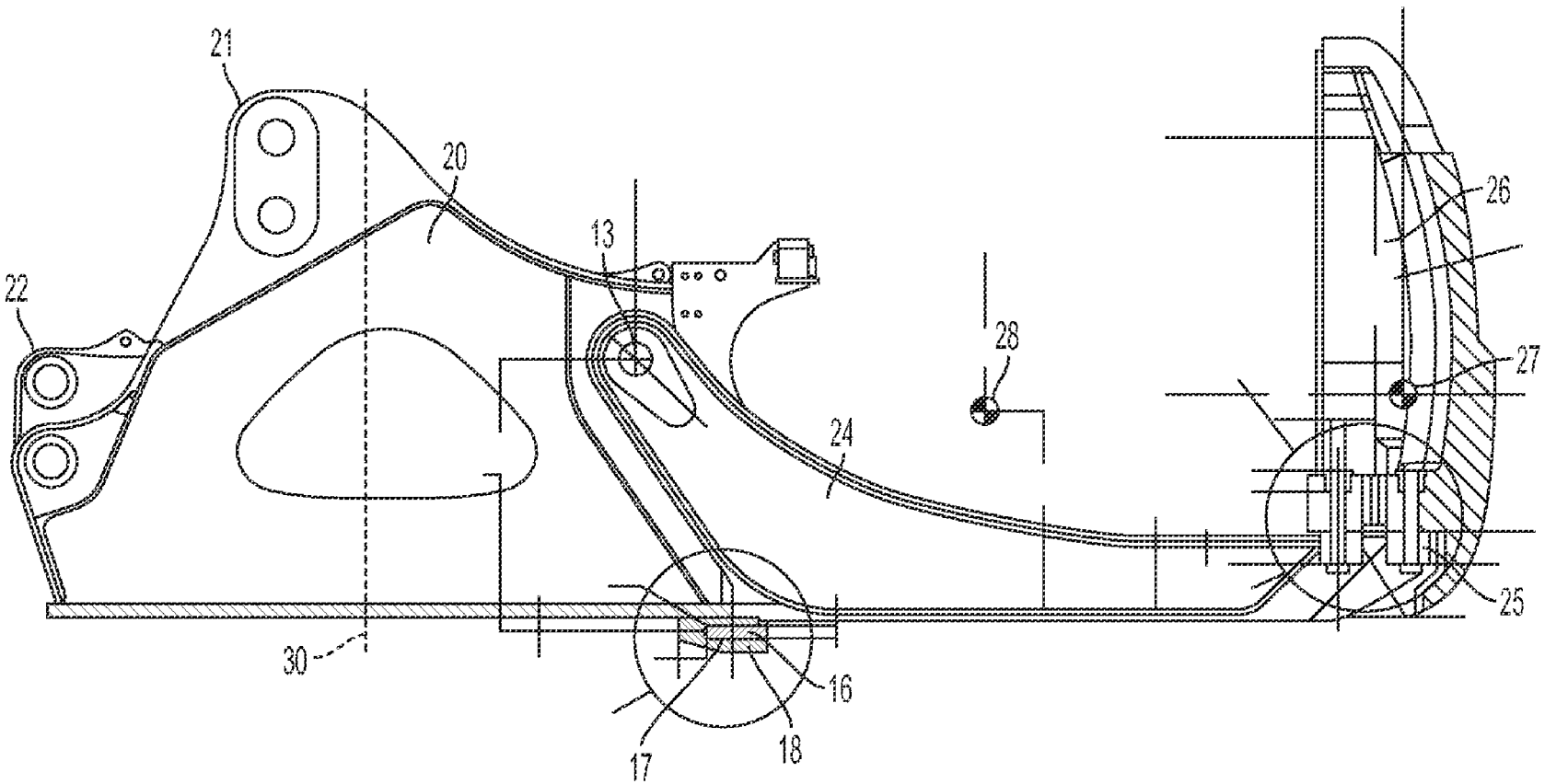
FIG. 6 shows the embodiment of the steel construction with mounted ballast in a side view.

The force conditions on the uppercarriage can be taken in particular from FIG. 6: Via the slewing ring 4 on its base plate, the first element 11 is rotatably arranged on the undercarriage about the vertical axis of rotation 30. All forces from the uppercarriage hence are transmitted to the undercarriage via the slewing ring of the first element. Furthermore, the excavator arm is pivotally attached to the first element via the attachment regions 21 and 22. The second element, on the other hand, carries the non-illustrated powerpack and the ballast 26, which in the rear connecting region 25 is attached to the second element by means of screws. The center of gravity of the ballast is designated with reference numeral 27, the center of gravity of the non-illustrated powerpack with reference numeral 28. Due to the distance of the centers of gravity 27 and 28 from the bolting axis, a static moment is obtained, which is transmitted from the second element to the first element in the stop regions 17 and 18. To retain the second element at the first element in particular during rotations of the uppercarriage, screws 16 furthermore are provided, which prevent a movement of the second element in a plane vertical to the bolting axis.

Figure 7:
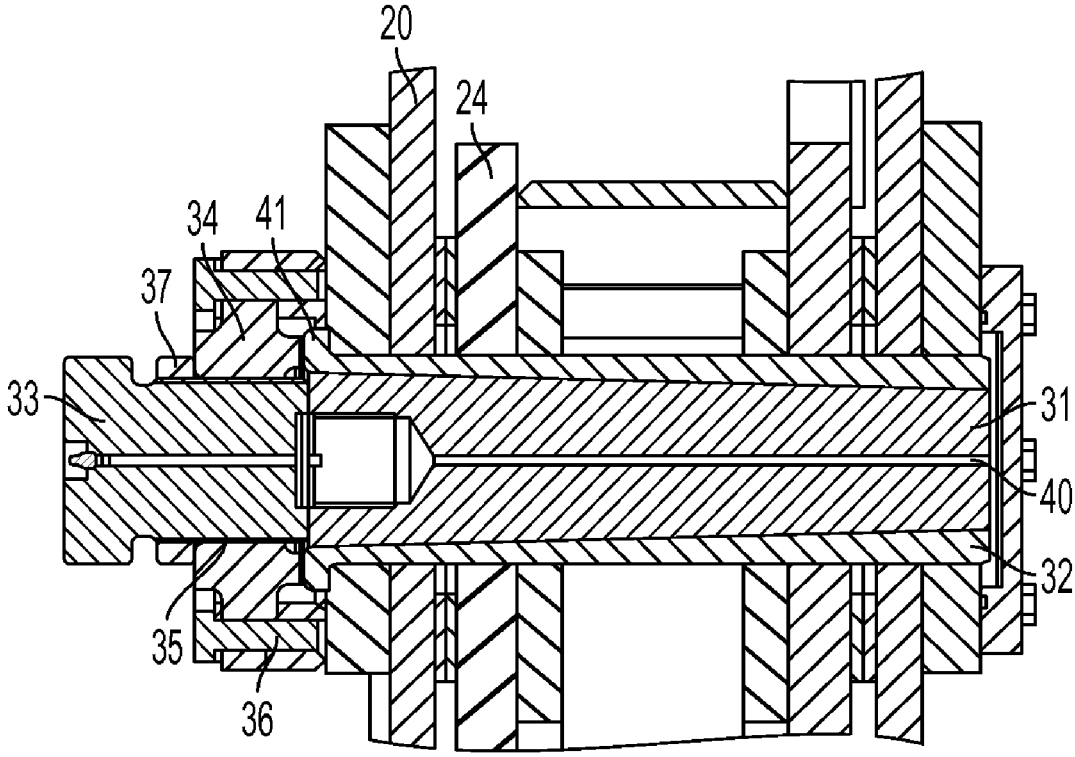
FIG. 7 shows an embodiment of a bolt connection of the invention in a sectional view.
Figure 8:
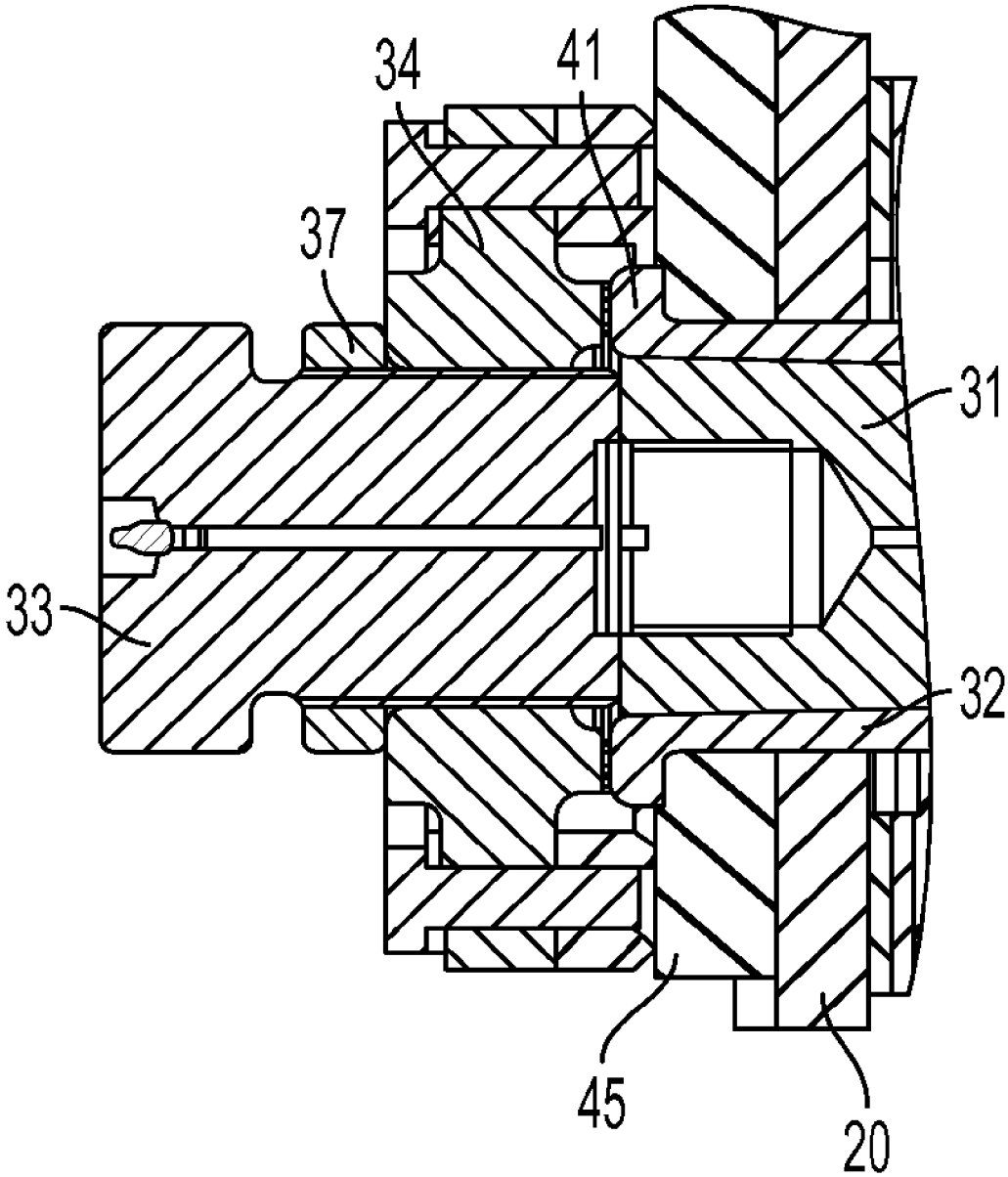
FIG. 8 shows an enlarged representation of the bolt connection shown in FIG. 7.
Figure 9:
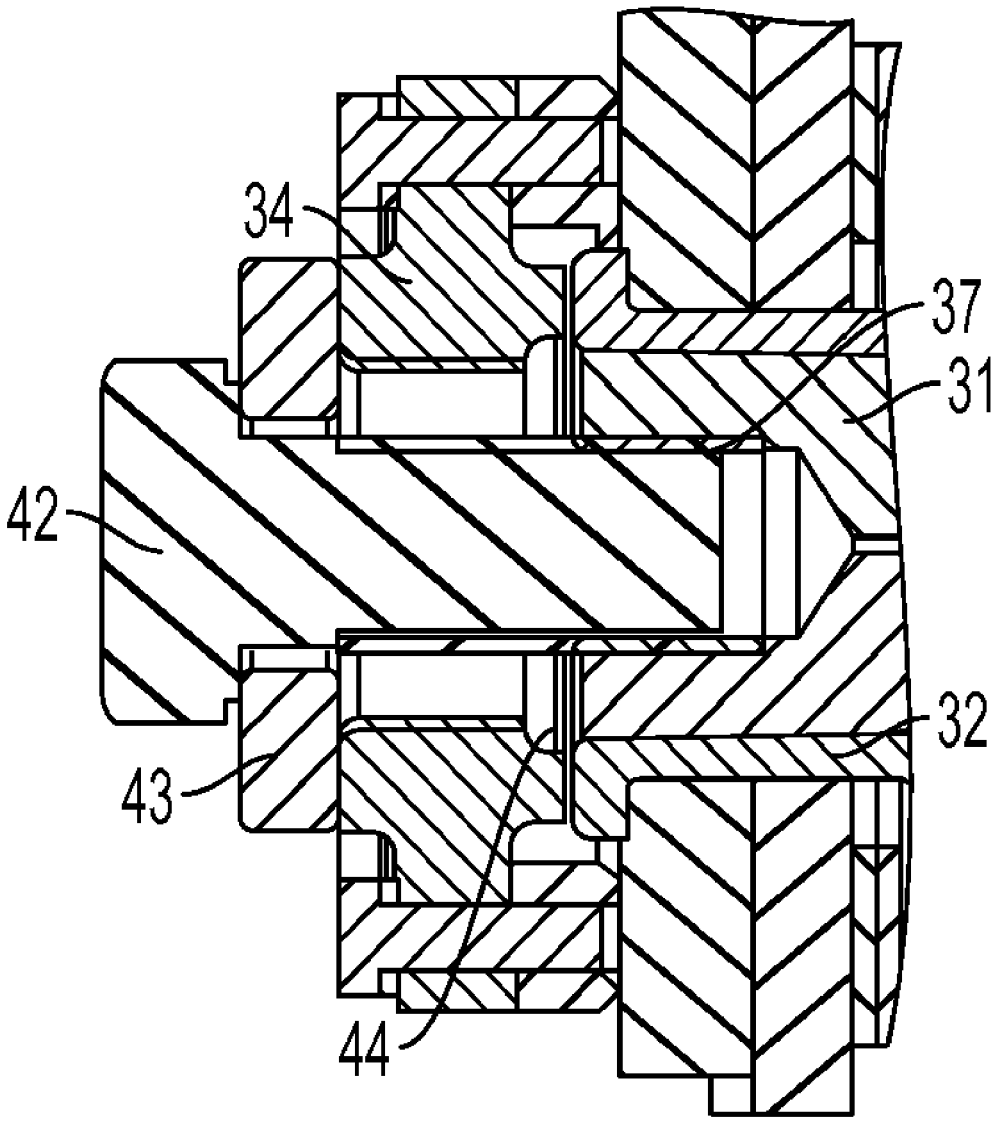
FIG. 9 shows the embodiment of the bolt connection with a pull-off screw as shown in FIGS. 7 and 8.

Since the screw connections in the lower region of the first and second elements should not be subjected to a transverse shear stress, the bolt connections must be absolutely free from clearance both in radial and in axial direction. FIGS. 7 to 9 now show an embodiment of a correspondingly configured bolt connection in accordance with the invention. The material used for the bolts is 42 CRM04 with a bolt diameter of 140 mm. The bolt has a two-part structure and is comprised of a split bushing 32 with conical inside diameter and a pressing piston 31 with conical outside diameter. The split bushing has a cylindrical outside diameter and is slotted in longitudinal direction, in order to improve its function. If the pressing piston 31 is axially pushed into the split bushing 32, its outside diameter is increased, whereby the bolt is braced against the bolt receptacles 14 and 15 with the side panels 20 and 24 of the first and second elements. The split bushing 32 has a collar 41, via which it rests on the side face of the bolt receptacle. The bearing surface between collar 41 and bolt receptacle is dimensioned such that the force acting on the split bushing when pressing in the bolt is transmitted by maintaining the admissible contact pressure. To also provide the steel construction of the first element with the required strength, doublings 45 are provided on the side panels 20 in the region of the bolt receptacles. The same are welded to the sheets of the side panels 20.

Due to the radial force produced when bolt and bolt receptacle are braced, a friction force is obtained, which prevents the bolt from being shifted in axial direction. The friction force produced upon pressing in the pressing piston 31 must be greater than the maximum occurring axial force during a movement of the uppercarriage. To avoid gaping between bolt and bolt receptacle in the case of a maximum acceleration, in particular during a rotation of the uppercarriage with corresponding centrifugal forces of the ballast, compression by the expanding piston and the split bushing should exceed the maximum occurring compression. To determine the maximum load of the connection, the weight force of the second element with powerpack and ballast is multiplied by the maximum acceleration of about 7g, which can occur with such appliances.

For compression of bolt and bolt receptacle, the pressing piston 31 is pressed into the split bushing 32 via a clinch screw 33. The clinch screw 33 is screwed into a holder 34, which is screwed to the side panel 20 of the first element. Furthermore, a self-locking nut 37 is provided, by means of which the clinch screw is held in position. With 140 mm, the clinch screw (M120) approximately is as large as the outside diameter of the bolt connection. In this way, the contact pressure on the end face of the pressing piston 31 or on the clinch screw is kept small. Secondly, this results in a short lever arm between the thread 35 of the holder and its connection with the side panel 20, so that the bending moment in the holder remains low.

The holder 34 is configured as disk, in the center of which the thread 35 is arranged for screwing in the clinch screw 33 and which is screwed to the side panel 20 via a plurality of screws 36, which are circularly arranged around the thread 35. The ten screws 36 for connecting the holder 34 with the side panel 20 form a pitch circle with a diameter of 235 mm.

As shown in FIG. 9, the clinch screw 33 initially is removed from the holder 34 for releasing the bolt connection, so that the end face of the expanding piston is accessible. For withdrawing the expanding piston 31 from the bushing 32, the expanding piston 31 has a thread 37 on its end face, into which a pull-off screw 42 can be screwed. The pull-off screw (M64 in this embodiment) has a smaller diameter than the clinch screw and thus can be screwed into the thread 37 through the holder 34. Furthermore, a washer 43 is used, via which the head of the pull-off screw 42 supports the holder 34. By tightening the screw connection, the expanding piston 31 can be shifted with respect to the split bushing 32 and hence the bolt connection can be released. The holder includes a recess 44, which permits a movement of the expanding piston 31 out of the split bushing 32.

With the bolt connections in accordance with the invention, a safe and absolutely backlash-free connection of the first and second elements of the load-bearing steel construction of the uppercarriage of the invention is ensured. Despite the two-part structure of the load-bearing steel construction of the uppercarriage no disadvantages are obtained in terms of stability.

Due to the inventive two-part structure with a first element, on which the rotary platform and the connecting regions with the dipper arm are arranged, and a second element, on which the central unit with powerpack and ballast is arranged, an improved handling is obtained during construction and transport of the uppercarriage, since the two individual parts of the load-bearing steel construction can be welded separately and can then safely be connected with each other via the bolt and screw connections.

The invention claimed is:

1. A traveling working machine, comprising:

a traveling gear;

an undercarriage on which the traveling gear is arranged; and an uppercarriage rotatably arranged on the undercarriage about a vertical axis of rotation, wherein a load-bearing steel construction of the uppercarriage is composed of at least one first element and one second element, which are connected with each other via bolts and/or screws, wherein a slewing ring for rotatable attachment of the uppercarriage to the undercarriage is arranged on the first element, wherein the connection of the first element with the second element comprises at least one or more bolt connections whose bolting axis extends horizontally, wherein the second element rests on the first element in at least one stop region, wherein the connection of the first element with the second element furthermore comprises at least one or more screw connections, which are arranged in the stop region, wherein screwing axes of the screw connections are orthogonal to the bolting axis and extend horizontally.

2. The traveling working machine according to claim 1, wherein the second element carries a ballast and/or a drive unit including a powerpack of the working machine.

3. The traveling working machine according to claim 1 wherein each bolt of the one or more bolt connections includes a split bushing with a conical inside diameter and a pressing piston with a conical outside diameter.

4. The traveling working machine according to claim 3, wherein the pressing piston is pressed into the split bushing via a clinch screw.

5. The traveling working machine according to claim 1, wherein connecting regions for connection with a dipper arm, boom or working tool are arranged on the first element.

6. A traveling working machine, comprising:

a traveling gear;

an undercarriage on which the traveling gear is arranged; and an uppercarriage rotatably arranged on the undercarriage about a vertical axis of rotation, wherein a load-bearing steel construction of the uppercarriage is composed of at least one first element and one second element, which are connected with each other via bolts and/or screws, wherein the connection of the first element with the second element comprises at least one or more bolt connections, each bolt including a split bushing with a conical inside diameter and a pressing piston with a conical outside diameter, wherein the pressing piston is pressed into the split bushing via a clinch screw, and wherein the clinch screw is screwed into a holder which is screwed to a welded construction carrying a bolt receptacle.

7. The traveling working machine according to claim 6, wherein the clinch screw has a diameter which is more than half of a diameter of the bolt.

8. The traveling working machine according to claim 7, wherein an end face of the pressing piston is provided with a connecting element for connection with a tension element, the tension element including a thread for screwing-in a pull-off screw.

9. The traveling working machine according to claim 8, wherein a washer is provided, which the pull-off screw supports, wherein the washer advantageously supports the holder into which the clinch screw can be screwed.

10. A set comprising:

a clinch screw;

a bolt including a split bushing with a conical inside diameter and a pressing piston with a conical outside diameter, wherein the pressing piston is pressed into the split bushing via the clinch screw;

a holder; and a washer;

wherein the clinch screw is screwed into the holder which is screwed to a welded construction carrying a bolt receptacle, and wherein the clinch screw has a diameter which is more than half of a diameter of the bolt.

11. The set to claim 10, further comprising a pull-off screw, wherein an end face of the pressing piston is provided with a connecting element for connection with a tension element, the tension element including a thread for screwing-in the pull-off screw.

12. The set according to claim 11, wherein the washer supports the pull-off screw.

* * * * *